US005943838A

United States Patent [19]

Madsen et al.

[11] Patent Number: 5,943,838

[45] Date of Patent: Aug. 31, 1999

[54] METAL STUD WITH BENDABLE TAB CHANNEL SUPPORT

[75] Inventors: Robert L. Madsen, Harrisburg; William L. Knorr, Salem, both of Oreg.

[73] Assignee: Kwik Bridge Punch Systems, LLC, Corvallis, Oreg.

[21] Appl. No.: 09/085,392

[22] Filed: May 27, 1998

[51] Int. Cl.[6] ..... E04B 2/60

[52] U.S. Cl. ..... 52/733.2; 52/481.1; 52/655.1; 52/656.1; 52/656.9; 52/731.7; 52/731.8; 52/731.9; 52/732.3; 52/733.3; 52/736.2; 52/745.1; 52/745.2

[58] Field of Search ..... 52/664, 243, 721, 52/354–6, 762, 481.1, 653.1, 656.1, 733.2, 733.3, 736.2, 731.7, 731.8, 731.9, 732.3, 655.1, 656.9, 745.1, 745.2

[56] References Cited

U.S. PATENT DOCUMENTS

| | | | |
|---|---|---|---|
| 3,305,981 | 2/1967 | Biggs | 52/243 |
| 3,423,893 | 1/1969 | Hyatt | 52/667 |
| 3,562,970 | 2/1971 | Schwartz | 52/243 |
| 4,235,054 | 11/1980 | Cable et al. | 52/210 |
| 5,155,962 | 10/1992 | Burkstrand | 52/667 |
| 5,313,752 | 5/1994 | Hatzinikolas | 52/243 |

OTHER PUBLICATIONS

Metal Stud Manufacturer's Association standards brochure, front, inside cover, and p. 52, Feb. 1995.

*Primary Examiner*—Christopher T. Kent
*Attorney, Agent, or Firm*—Klarquist Sparkman Campbell Leigh & Whinston LLP

[57] ABSTRACT

A metal stud having a central web between a pair of opposed flanges includes an opening in the web through which a channel can pass. The opening has at least one straight edge and a centrally disposed bendable tab extending into the opening. The width of the tab is substantially less than the width of the opening. Bending the tab to a position at right angles to the web of the stud provides a surface to which the channel can be attached. A framework is disclosed which comprises a plurality of such metal studs having openings in their webs through which the channel is passed and then attached to the bent tabs.

4 Claims, 3 Drawing Sheets

METAL STUD WITH BENDABLE TAB CHANNEL SUPPORT

BACKGROUND OF THE INVENTION

This invention relates to an improved metal stud for use in combination with horizontal metal channels in the construction of frameworks for walls, floors and ceilings, and roof construction, and more particularly, to such a stud having an opening in the stud web through which the horizontal channel can pass. The purpose of the channel, which is positively attached to the stud in frameworks of this type, is to function as a stabilizing and stiffening element for the framework. The channel prevents the stud from buckling and/or from rotating intermediate its ends.

Channels have been used for the purposes aforesaid with studs manufactured by various manufacturers. The studs are often characterized by the shapes of the cut-outs or openings in the webs through which the channels pass. Some of the studs have utilized cut-outs or openings having at least one straight edge, which then can serve as a support for the channel. In those cases one leg of a short angle section has been welded or otherwise fastened to the stud web adjacent the opening, the web of the channel then being fastened to the other leg of the angle section, thereby to attach the channel positively to the stud. Use of such an angle section, however, as should be evident, makes any framework relatively costly to construct.

Another method of attaching a channel to a series of studs was disclosed in Menchetti U.S. Pat. No. 4,693,047, wherein the openings in the stud webs were provided with bendable portions affixed to the balance of the metal of the stud web. Such portions were formed to be bent inwardly from the sides of the openings to engage and stabilize a channel passing therethrough and to attach the channel to the stud web. The resulting structure, however, was complicated and thus, also costly to construct.

A wall framing system comprising conventional studs and utilizing a channel shaped ceiling rail or track was disclosed in Hatzinikolas U.S. Pat. No. 5,313,752. In this system the web of a ceiling rail was provided with a series of U-shaped cuts. Each cut defined a rectangular tab, which was then folded along a transverse fold line, bent 90 degrees, provided with T-shaped slots, and attached to the vertical web of a stud by bolts and inserts, which latter provided for relative vertical movement between the stud and the ceiling rail. The Hatzinikolas system contemplated a horizontal rail or track, wherein the rectangular tab forming a connector plate projected substantially vertically from the interior of the ceiling rail such that it could be movably attached to the substantially vertical stud. On the contrary, frameworks contemplated by our invention must be suitable for use in a variety of situations, including vertically extending walls, horizontally disposed floors and ceilings, and even in sloped roof construction.

In the Hatzinikolas system, as above noted, the rectangular tab must be bent inwardly of the horizontally disposed, channel-shaped ceiling rail. Frameworks contemplated by our invention, however, may require that the channels be attached by means which extend either outwardly or inwardly of the channel-shaped stud. In typical wall and floor systems the attaching means generally extend outwardly of the web of the channel-shaped stud. In some situations, however, such as in vertically extending walls at corners and also at openings for doors and windows, the channel attaching means must extend inwardly of the channel-shaped stud.

In the Hatzinikolas system, the vertical stud necessarily terminates at the horizontal webs of the channel-shaped rails, and thus is attached to, at most, two rectangular tabs, one projecting downwardly from the interior of the uppermost rail and the other projecting upwardly from the interior of a lower rail. In frameworks contemplated by our invention, the channel that is attached to the attaching means generally passes through the web of the channel-shaped stud, and thus may be attached to a plurality of studs forming the framework.

In the Hatzinikolas system as above mentioned, the connection of the rectangular tab to the vertical stud is intended to create a "slip" type of connection; that is, it is intended to allow relative movement between the tab and the stud. In frameworks contemplated by our invention, the channel must be positively attached to the attaching means to prevent any relative movement between the stud and the channel because the channel must function as a stabilizing and stiffening member in the wall, ceiling, floor or roof construction framework. Because the Hatzinikolas system requires a slip connection between the vertical stud and the rectangular tab, suitable connectors are limited to screw or bolt type fasteners. In frameworks contemplated by our invention, it is unwise to limit the type of connecting means used to attach the channel to the web of the stud through which it may pass.

In the Hatzinikolas system, there is nothing disclosed to prevent buckling or rotation of the stud intermediate its ends. On the contrary, frameworks contemplated by our invention utilize one or more channels to stabilize a vertically disposed, channel-shaped stud or a horizontally disposed, channel-shaped joist along the full length of the stud or joist.

Furthermore, in the Hatzinikolas system, the rectangular tab extended the full width of the U-shaped cut in the ceiling or floor rail or track. We have found that it is difficult to bend a tab that extends substantially the full width of a cut or opening in a web without distorting the web. We have found that such a tab does not bend squarely.

It is thus the principal object of the present invention to provide an improved metal stud for use in combination with a stiffening metal channel, and wherein the stud is provided with an opening to receive the channel.

It is a further object of the present invention to provide such a stud with an improved, but very economical stabilized interconnection between the metal channel and the opening in the stud web through which the channel may pass.

It is a still further object of the present invention to provide such a stud wherein the web opening has at least one straight edge and a bendable tab formed at the straight edge, such that when the tab is bent, either inwardly or outwardly, to a position at right angles to the web of the stud, the tab can be easily but positively attached to a surface of the web of the channel, thereby to attach the channel positively to the stud and function as a stabilizing and stiffening element for the framework.

It is a further object of the invention to provide an improved, economical framework comprising studs as aforesaid, and wherein a channel extends through openings in the stud webs, the tabs at the straight edges of the web openings being bent to right angle positions to abut and support a surface of the web of the channel, and wherein the orientation of the framework is not important.

It is a still further object of the invention to provide a framework as aforesaid where the element being attached to the tab, for example, the channel, passes continuously through the opening in the web of the stud such that it can be attached to any number of tabs.

It is a still further object of the invention to provide such a framework wherein the type of connecting means used to attach the tab to the web of the stiffening element, for example, the channel, is not limited to any particular type, such as screw or bolt type fasteners.

It is a still further object of the invention to provide such a framework wherein the stud or joist is stabilized against buckling and rotation along its length and not just at its ends.

It is a still further object of the invention to provide a method of making a framework in accordance with the objects above set forth.

SUMMARY OF THE INVENTION

The present invention provides an economical solution to the problem above discussed. It provides a metal stud of the type having a pair of opposed flanges and a central web joining the flanges, and wherein the stud web has an opening which comprises at least one straight edge. The opening is formed with a bendable tab disposed along the straight edge. The tab has a width substantially less than the width of the opening along the straight edge. When the tab is bent to a position at right angles to the surface of the web, either inwardly or outwardly thereof, it is adapted to be attached to a surface of a stiffening member for example, the channel web, thereby to permit the stiffening member or channel to be positively attached to the stud.

The invention further provides an improved framework, wherein a stiffening member is mounted to extend horizontally through openings in the webs of a plurality of studs, which openings are formed as above set forth and are in alignment with each other. When the tabs are bent to positions at right angles to the stud webs, they can be attached to a surface of the stiffening member, thereby to attach the stud positively to the member. Forming the tabs with a width substantially less than the width of the straight edge allows the tab to be bent squarely, whether the tab is bent inwardly or outwardly of the stud.

The invention further provides an improved method of making a framework comprising a plurality of metal studs and at least one stiffening member which is adapted to pass through openings in the studs. The method comprises punching an aligned opening in the web of each of the studs, wherein each of the openings comprises at least one straight edge and a bendable tab extending from the straight edge into the opening. The tab is centrally disposed along the straight edge and is of a width substantially less than the length of the straight edge. The method further comprises bending each of the tabs to a position at right angles to the web of its respective stud, passing the stiffening member through the openings with a surface of the stiffening member in contact with the surfaces of the tabs, and attaching the tabs to the surface of the stiffening member along its length.

DESCRIPTION OF THE PREFERRED EMBODIMENT

Figure 1:
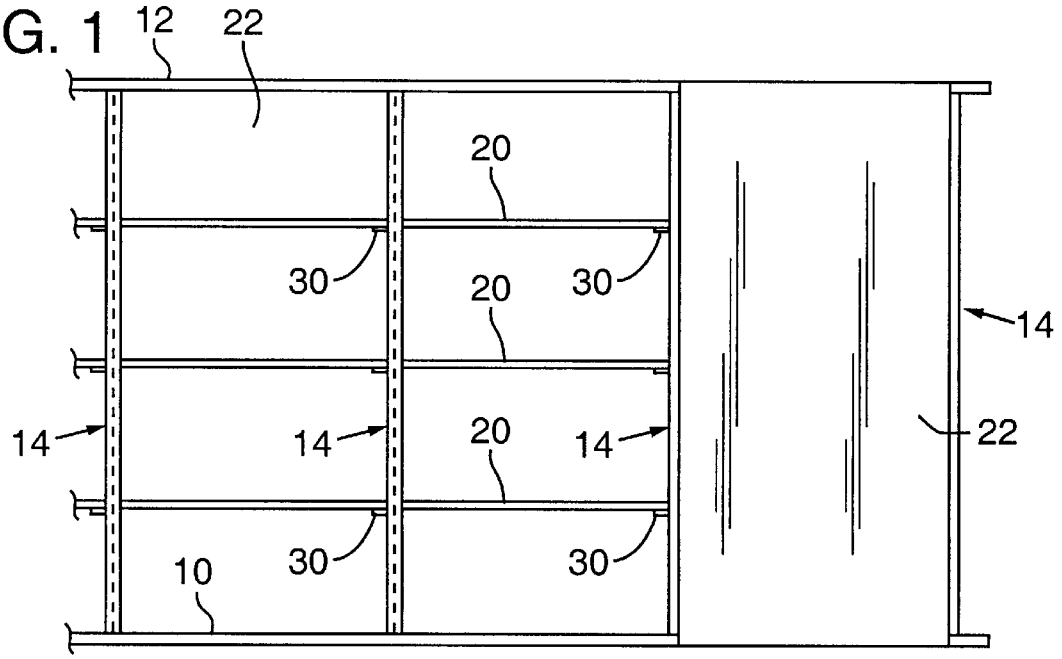
FIG. 1 is a side view of a partition wall system with some side panels removed to reveal a framework suitable for construction in accordance with the present invention.

Referring to FIGS. 1–4, a support framework is provided which includes channel-like runners 10, 12, mounted on the floor and ceiling, respectively. Laterally spaced vertical metal studs 14, which may, for example, be C-studs, having opposed flanges 15, extend between the runners 10, 12. Horizontally aligned cut-outs or openings 16 are punched out in the central webs 18 of the studs 14, through which, for example, horizontal channels 20 pass. The openings 16 are also utilized for electrical wiring as is well known in the trade. Wall panels 22 are attached to the studs 14 by means well known to the trade.

The openings 16 have a width about equal to the width of the channels 20, and such width can be between about three-quarters inch and two-and-one-half inches, depending on the channel and the stud involved. Desirably, the openings 16 are formed with a straight horizontal lower edge 26 and a semi-circular upper edge 28, and the height of the opening 16 from its lower edge 26 to the center of its upper edge 28 is desirably between about three and one-quarter and four and one-half inches.

Figure 4:
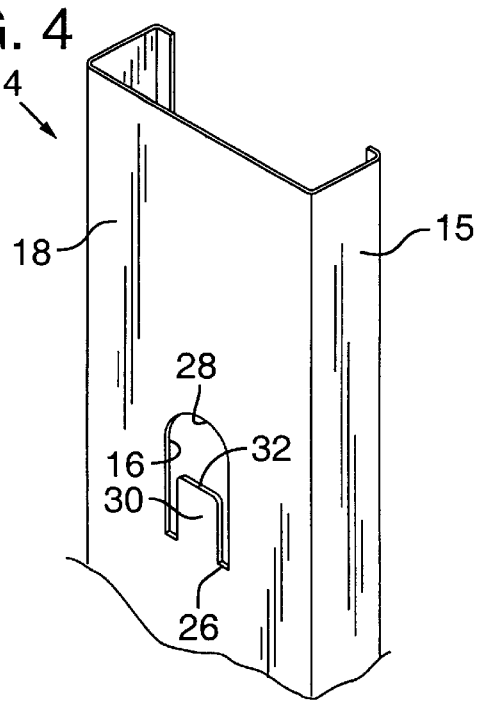
FIG. 4 is a perspective view of the stud illustrated in FIG. 3 illustrating the cut-out or opening and the tab prior to bending.

As illustrated in FIG. 4, each opening 16 is formed with an integral tab 30 centrally disposed at its horizontal lower edge 26. The width of the tab 30 is substantially less than the width of the edge 26 to enable the tab 30 to be bent squarely, as necessary to serve as a shelf or channel support. We have found that making the tab 30 about one-quarter inch to one-half inch less wide than the width of the lower edge 26 will facilitate bending the tab to the desired right angle or horizontal position. We have found that making the tab 30 the full width of the edge 26 does not permit it to be bent squarely.

Figure 2:
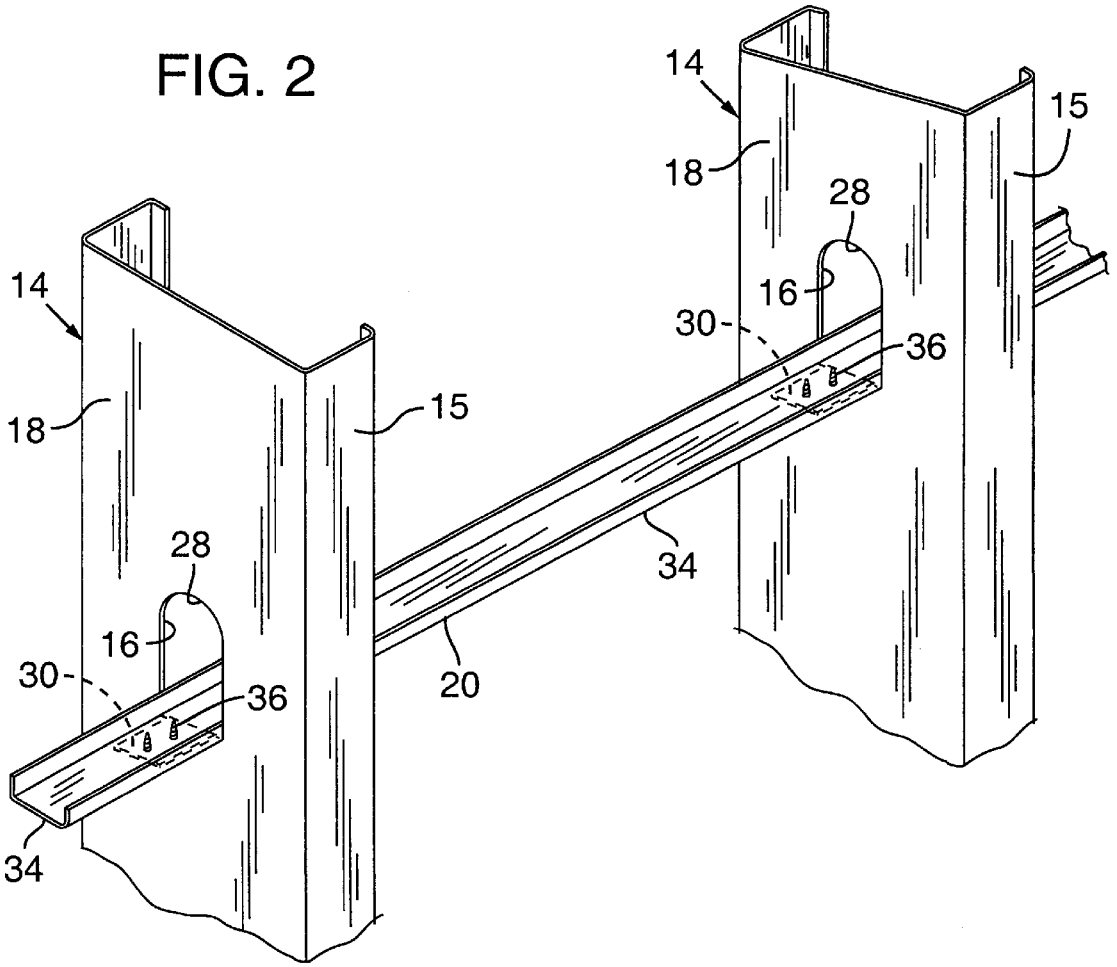
FIG. 2 is a perspective view of a portion of the framework of FIG. 1, illustrating a horizontal channel as it extends through openings in the webs of vertically oriented studs.
Figure 3:
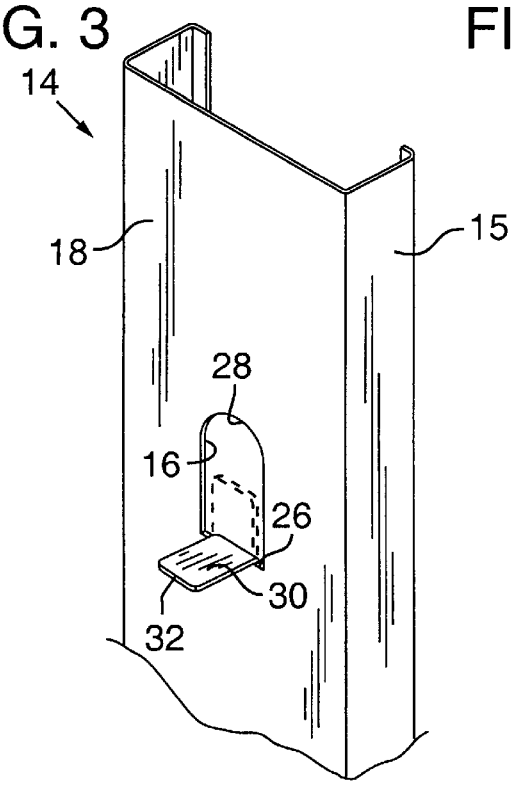
FIG. 3 is a perspective view of the stud illustrated in FIG. 2, wherein a tab formed at a straight edge of the web opening is bent to a horizontal position ready to support a horizontal channel or other stiffening member passing through the opening.

The tab 30 is preferably made about one and three-eighths inches long. If desired, it may be tapered in width at its upper edge 32. FIG. 3 illustrates the tab 30 after it has been bent to the right angle position. The channel 20 is passed through the openings 16 such that its lower surface 34 is supported by the horizontally bent tabs 30. The channel is then fastened to each of the tabs 30 by, for example, two self-tapping screws 36, as shown in FIG. 2. Fasteners of other types can be used. Such examples include other types of metal screws, pins or nails, welds, and known clinching systems. The type of fastener is not critical to the invention as long as the attachment does not provide for any relative movement between the tab 30 and the surface of the stiffening member to which the tab is attached.

Figure 5:
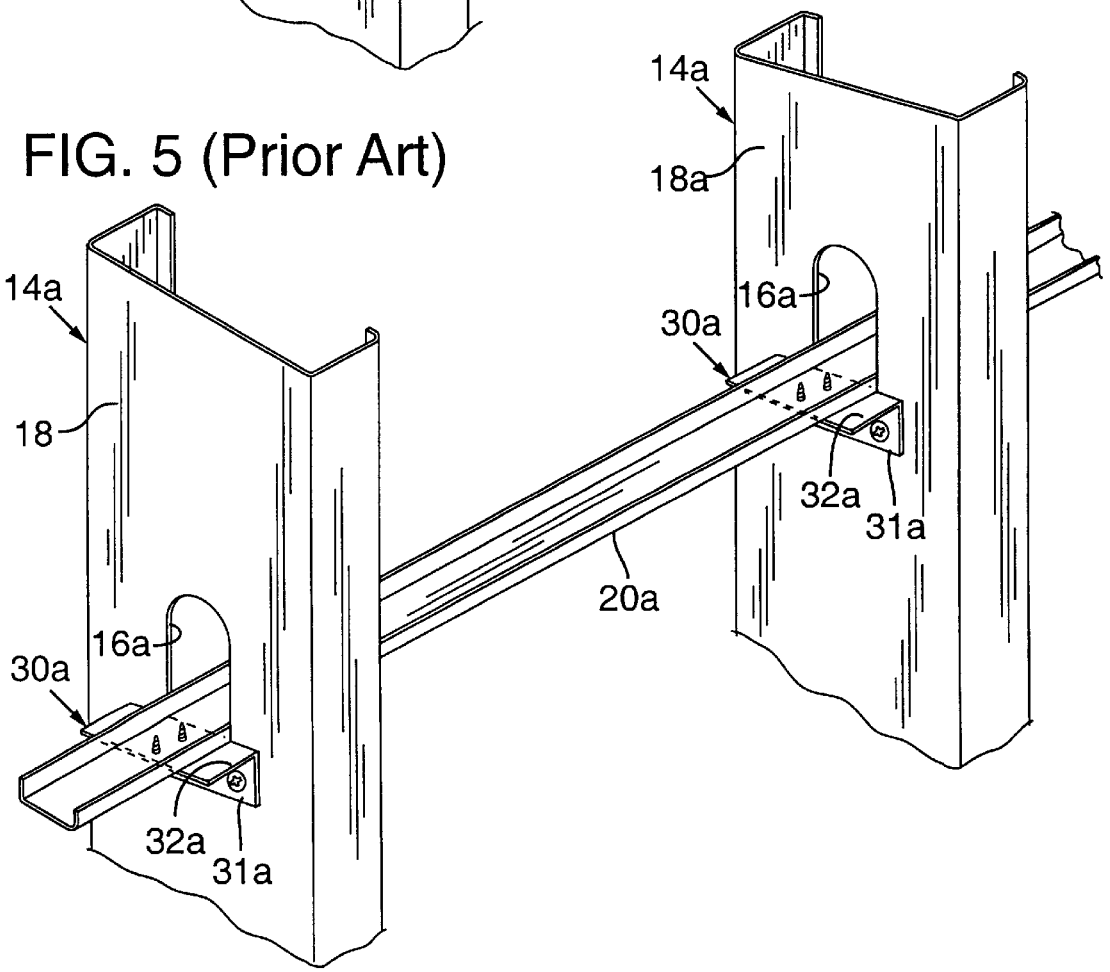
FIG. 5 (Prior Art)
FIG. 5 is a perspective view of a portion of a similar vertical wall framework constructed using separate angle sections in accordance with the prior art.

FIG. 5 illustrates a prior art stud 14*a* having a substantially similar cutout or opening 16*a*, but without the integral tab. A short angle section 30*a* has its vertical leg 31*a* welded or otherwise fastened to the stud web 18*a* just below the opening 16*a*. The horizontal channel 20*a* is then fastened by screws to the horizontal leg 32*a,* thereby to fasten the channel 20*a* to the stud 14*a*. Constructing a wall framework using such angle sections is considerably more expensive than by utilizing the stud and method of our invention.

Figure 6:
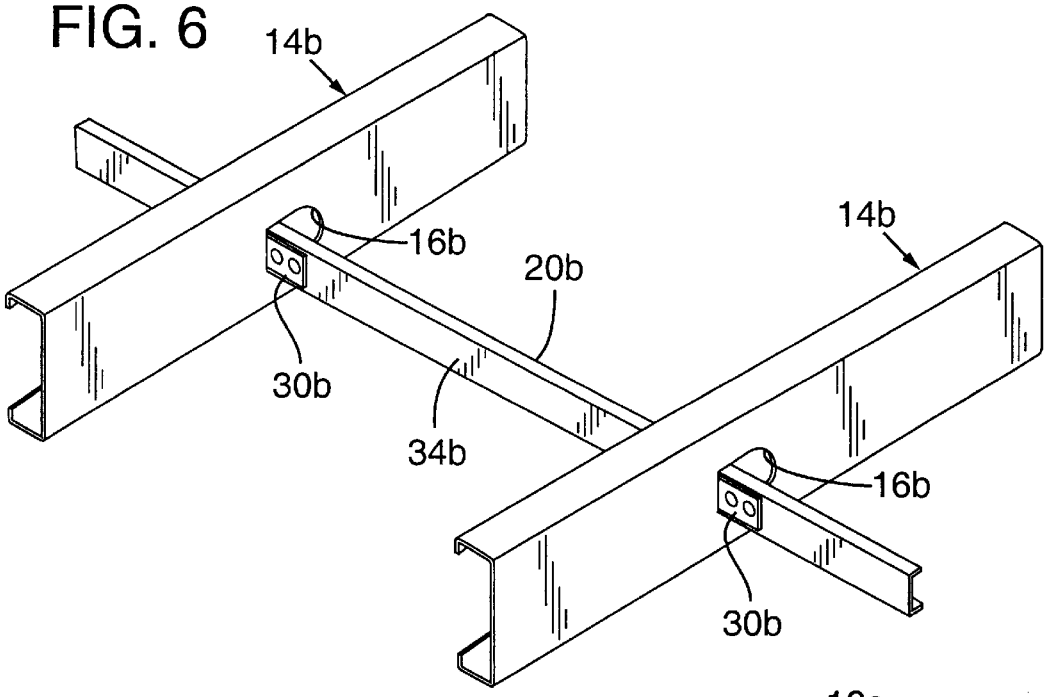
FIG. 6 is a perspective view of the invention as applied to a framework that can be oriented either horizontally or sloped, such as might be suitable for floors and ceilings, or in roof construction.

FIG. 6 illustrates an application of the invention in the construction of ceilings and floors. Studs 14*b* formed with openings 16*b* and tabs 30*b* as above described are oriented horizontally as required in a floor or ceiling construction. In the case of a roof framing, the stud 14*b* would be sloped, as required of a roof rafter. The openings 16*b* are aligned as aforesaid and a channel 20*b* is passed therethrough. The tabs 30*b* are attached to the exterior surface 34*b* of the channel 20*b* by means as aforesaid.

Figure 7:
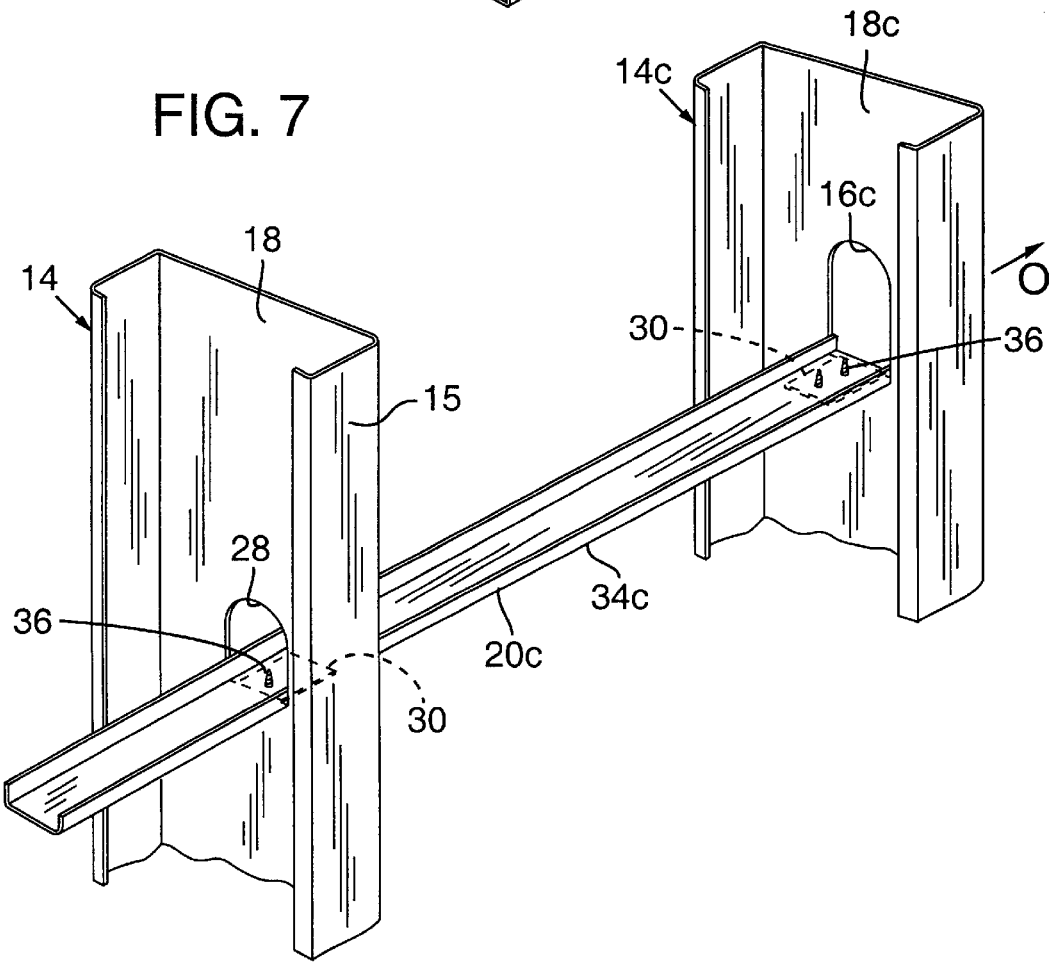
FIG. 7 is a perspective view of the framework of the invention as applied in the construction of a vertical wall at a door or window opening, or at a corner.

FIG. 7 illustrates a framing construction suitable for use at door or window openings or at wall corners. Stud 14 is constructed as described hereinabove. Stud 14*c* is provided with an opening 16*c* and a bendable tab 30*c*, but in this case the tab 30*c* is bent inwardly of the stud 14*c* such that it will not interfere with a desired opening O exterior to the stud 14*c*. Bending the tab 30*c* inwardly of the stud 14*c* to a position at right angles to the web 18*c* allows the tab 30*c* to be attached to the exterior surface 34*c* of the channel 20*c,* whose length it is desired to terminate at the opening O.

The method of our invention is illustrated in the case of a vertical application in FIGS. 1–4. It comprises punching aligned openings 16 in the webs 18 of a plurality of studs 14. Each of the openings 16 has a straight edge 26 and is punched such that a bendable portion 30 is centrally disposed along the edge 26. The bendable portion 30 has a width substantially less than the length of the edge 26 and extends into the opening 16, as shown. This portion 30 can then serve as the bendable tab. The tabs 30, being of a width substantially less than the width of the edges 26, can be bent squarely to positions at right angles to the web 18.

The method then comprises bending each of the tabs 30 to a position at right angles to its respective web 18 to serve as a horizontal shelf in the case of a vertical application. A channel 20 or other type of stiffening member is then passed through the aligned openings 16 such that its lower surface 34 is supported by the tabs 30, whereupon the channel 20 is attached to the tabs 30 by fastening means as aforesaid.

It should be understood that the foregoing description is to be considered as illustrative only of the principles of our invention, which is not to be limited to the precise embodiment disclosed. Rather, we claim all suitable modifications and equivalents which fall within the scope of the following claims.

We claim:

1. A metal stud comprising:

a pair of opposed flanges; and a central web joining the flanges, the web having at least one opening for the reception of a stiffening member passing therethrough, the stiffening member comprising a flat surface, the opening comprising at least one straight edge;

the web further comprising a bendable tab integral with the web and extending into the opening a distance substantially less than the length of the opening, the tab being centrally disposed along the straight edge, the tab having a width substantially less than the width of the opening along the straight edge, the tab being adapted to abut the surface of the stiffening member when the tab is bent to a position at right angles to the web, the tab being adapted to be positively attached to the surface of the stiffening member, thereby to positively attach the stud to the surface of the stiffening member.

2. A framework comprising a plurality of studs as defined in claim 1, the openings in the webs of the studs being in alignment with each other;

a stiffening member comprising a flat surface extending through the aligned openings in the webs of the studs, the stiffening member having a width equal to the width of the openings in the webs of the studs, the tabs of the openings being bent at right angles to the webs of the studs to positions that abut and support the flat surface of the stiffening member; and means to fasten the tabs to the flat surface of the stiffening member to positively attach the studs to the stiffening member and prevent any relative movement between the stiffening member and the tabs.

3. The framework of claim 2, wherein the studs comprise C-studs and the stiffening member comprises a channel comprising a pair of opposed flanges and a central web joining the flanges, the tabs of the openings in the webs of the studs being attached to the central web of the channel.

4. A method of making a framework comprising a plurality of metal studs and at least one stiffening member, each of the studs having opposed flanges and a central web connecting the flanges, the stiffening member comprising a flat surface, the method comprising:

punching an aligned opening in the web of each of the studs, each of the openings comprising at least one straight edge, the web comprising an integral bendable tab extending from the straight edge into the opening a distance substantially less than the length of the opening, the tab being centrally disposed along the straight edge and having a width substantially less than the width of the opening along the straight edge;

bending each of the tabs to a position at right angles to the web of the respective stud;

passing the stiffening member through the openings with the flat surface of the stiffening member in contact with the surfaces of the tabs; and positively attaching the flat surface of the stiffening member to the tabs to prevent any relative movement between the flat surface of the stiffening member and the tabs.

* * * * *

UNITED STATES PATENT AND TRADEMARK OFFICE

CERTIFICATE OF CORRECTION

PATENT NO. : 5,943,838
DATED : August 31, 1999
INVENTOR(S) : Madsen et al.

It is certified that error appears in the above-identified patent and that said Letters Patent is hereby corrected as shown below:

Title page,
Item [56], References Cited, please insert:

| | | | |
|---|---|---|---|
| -- | 3,604,176 | 9/1971 | Campbell |
| | 3,778,952 | 12/1973 | Soucy |
| | 3,908,328 | 9/1975 | Nelsson |
| | 3,940,899 | 3/1976 | Balinski |
| | 4,693,047 | 9/1987 | Menchetti |
| | 4,858,407 | 8/1989 | Smolik -- |

Signed and Sealed this

Thirty-first Day of December, 2002

JAMES E. ROGAN
*Director of the United States Patent and Trademark Office*